US010176975B2

(12) United States Patent
Koller

(10) Patent No.: US 10,176,975 B2
(45) Date of Patent: Jan. 8, 2019

(54) DETECTOR PLATE FOR RADIATION ANALYSIS AND METHOD FOR PRODUCING SAME

(71) Applicant: Peter Koller, Erlangen (DE)

(72) Inventor: Peter Koller, Erlangen (DE)

( * ) Notice: Subject to any disclaimer, the term of this patent is extended or adjusted under 35 U.S.C. 154(b) by 269 days.

(21) Appl. No.: 14/902,491

(22) PCT Filed: Jul. 1, 2014

(86) PCT No.: PCT/EP2014/001793
§ 371 (c)(1),
(2) Date: Sep. 30, 2016

(87) PCT Pub. No.: WO2015/000582
PCT Pub. Date: Jan. 8, 2015

(65) Prior Publication Data

US 2017/0011896 A1 Jan. 12, 2017

(30) Foreign Application Priority Data

Jul. 3, 2013 (DE) ..... 10 2013 011 077

(51) Int. Cl.
*H01J 47/08* (2006.01)
*H01J 47/02* (2006.01)

(52) U.S. Cl.
CPC ..... *H01J 47/08* (2013.01); *H01J 47/02* (2013.01)

(58) Field of Classification Search
CPC ..... H01J 47/08
See application file for complete search history.

(56) References Cited

U.S. PATENT DOCUMENTS

| | | | |
|---|---|---|---|
| 6,121,622 | A | 9/2000 | Beyne et al. |
| 7,470,912 | B2 | 12/2008 | Schmidt et al. |
| 7,476,867 | B2 | 1/2009 | Fritsch et al. |
| 2002/0153492 | A1 | 10/2002 | Sekine et al. |
| 2006/0138340 | A1 | 6/2006 | Ianakiev et al. |

FOREIGN PATENT DOCUMENTS

| | | | |
|---|---|---|---|
| EP | 0280779 | A1 | 9/1988 |
| EP | 0936659 | A1 | 8/1999 |

OTHER PUBLICATIONS

International Search Report for PCT1EP2014/001793, dated Jan. 16, 2015.

*Primary Examiner* — Michael C Bryant
(74) *Attorney, Agent, or Firm* — Merchant & Gould P.C.

(57) ABSTRACT

A detector plate includes a carrier plate, especially an injection-molded carrier plate, having a plurality of detector elements for detecting ionizing radiation. The detector elements function according to the principle of a Geiger-Müller counter. To simplify the production process and to save cost, the anode and/or the cathode should be in the form of a metallization on the carrier plate of the detector plate, the metallization(s) not being present in a single plane only. This configuration offers multiple options for designing the interior used as ionization chamber and for arranging the electrodes in this space. The options for contact with additional printed circuit boards also turn out to be highly advantageous. This further has an advantageous effect on the production process and on the qualities of the radiation measurement devices using detector plates of this kind.

18 Claims, 6 Drawing Sheets

DETECTOR PLATE FOR RADIATION ANALYSIS AND METHOD FOR PRODUCING SAME

This application is a National Stage Application of PCT/EP2014/001793, filed 1 Jul. 2014, which claims benefit of 10 2013 011 077.7, filed 3 Jul. 2013 in Germany, which applications are incorporated herein by reference. To the extent appropriate, a claim of priority is made to each of the above disclosed applications.

BACKGROUND OF THE INVENTION

For radiation detection the scintillation principle was used that was further refined over time, whereby radiation image sensors, in particular scintillator plates, were developed, which, through the arrangement of a number of radiation detectors that had a scintillator and light detector, allowed statements regarding the radiation profile of the ionizing radiation. On this basis it was possible to analyze a two-dimensional distribution of the radiation intensity, for example, for x-ray devices used in the medical sector. Over time, the arrangements of the individual detector elements have become smaller and have improved greatly.

U.S. Pat. No. 7,476,867 B2 describes detector plates with a number of detector elements used for detecting ionizing radiation. Thereby, detection elements generate an electrical ionization current between the anode and cathode. The method aims to improve the measuring precision by deploying a segmented electrode.

U.S. Pat. No. 7,470,912 B2 describes a tool for quality control of therapeutic radiation, which is designed for the ionization detection of electrons as well as X-ray radiation.

U.S. Pat. No. 6,121,622 A describes an analysis device for the generation of two-dimensional X-ray images, which is reduced in terms of its size and complexity. For this purpose, a pixeled anode is used, whose pixels are included in an insulating layer, whilst retaining their shape, and positioned in a defined position with respect to the cathode. US 2002/0153492 A1 describes a component of a radiation detector which is formed of a scintillator array and a corresponding photodiode array on an MID substrate.

SUMMARY OF THE INVENTION

According to the invention, for a detector plate of the aforementioned type, this problem is solved by the detection elements which are designed to generate an electrical ionization current between the anode and a cathode of the respective detector element, with direct or indirect ionization by the ionizing radiation in an inner cavity of the respective detector element, whereby the anode and/or the cathode is formed in an electro-conductive application not lying on a single plane on the carrier plate.

There is greater freedom and more design options in the structuring of the interior because the anode and/or cathode no longer stand in the way of a spatial formation; rather, the dimensioning of the interior can be better aligned to high voltage characteristics and/or ionization characteristics. In addition, the space can be used more effectively because the additional options allow for a scalable arrangement of detector elements.

In an advantageous embodiment, the carrier plate is an injection-molded carrier plate. This property of the carrier plate results from an injection-molded process used in their manufacture. Several processes already known can be understood as the injection molding process. Examples include the single-component injection molding process or the double-component injection molding process. In both cases, a plastic in liquid or foam form is poured into an injection molding tool, whereby the plastic adapts to the form of said tool. In so doing, complex structures are generated, whereby the anode and/or the cathode can be formed as an electro-conductive application lying not only in a single plane but rather in multiple planes of different orientations on the carrier plate.

The electro-conductive application of the injection-molded plastic is based on MID (Molded Interconnect Devices) technology. With this technology, metallic conductor paths can be applied on injection-molded plastic carriers. This application is listed below as metalization, carbonization, or as conductive ink. Based on this technology, it is possible to form the electro-conductive application, or the anode and/or cathode of a detector element, in such a way that this can optimally form an inner cavity of the detector element, whereby, ideally, the size of the ionization chamber can be precisely defined. Here, it must be observed that in contrast to other processes, the injection mold is enormously precise, whereby at the same time it is also ensured that no soiling remains in the inner cavities of the carrier plate. With common types of detector plates, a large amount of rejects can be produced if the detector plate does not correspond to the reproducibility requirements. Injection molding can significantly counter this, while ensuring a form precision of up to 10 micrometers.

In an advantageous embodiment, the carrier plate is manufactured by non-cutting production and/or press-molded. Non-cutting production refers to a processing of an output workpiece or an intermediate product, in which a material abrasion leads to the desired shape of the carrier plate. The material removal can be achieved for example, by planing, punching, grinding or drilling. Additionally or alternatively, the output workpiece or the intermediate product is press-molded to reach the desired shape of the carrier plate. Press-molding can involve cold or warm molding, which, for example, can be selected depending on the material used, especially plastic. Similarly, a combination of non-cutting production and press-molding is possible whereby non-cutting production and then press-molding is carried out, or vice versa.

In an advantageous embodiment, the inner cavity is at least partly formed in the carrier plate by means of a deepening or a depression. In this way, it is possible that via the deepening or the depression an inner cavity is at least partly enclosed, so that a large part of the volume used for ionization can already be enclosed by the carrier plate, whereby solely a covering or a closure by means of a flat protective element can already provide a complete ionization chamber in the form of the inner cavity.

Preferred is the electro-conductive application, a metalization, a carbonization, or a conductive ink. To the extent that the required voltage and ionization current are ensured, the production of a detector plate can be simplified by the respective processes of forming the electro-conductive application.

Of advantage is the fact that when using MID technology, it is possible to provide metalizations in the deepening or the depression, so that forming the anode and/or cathode is easily possible, especially when anode and cathode are lying mostly opposite one another, and when a sufficiently large part of the inner cavity is arranged between the two electrodes. This, on the one hand, is of advantage because a high voltage exists between the two electrodes, which, during operation, typically has a value of 500 volts. On the other hand, the distribution of the inner cavity can be optionally designed in such a way that a defined ionization volume is present in all detector elements used.

In an advantageous embodiment, the depression of the respective detector element has one or two openings with one through-contact each through the injection-molded carrier plate. By means of the openings, it is possible that the electrodes arranged in the inner cavity can be contacted towards the exterior (with regard to the inner cavity). For example, openings on a surface of the depression or deepening can be used for creating one or more through-contacts, whereby, for example, in combination with a solder bump or similar, an electrical contact can be produced with a conductor plate arranged parallel to the carrier plate. If two openings are used, it is also possible to provide two through-contacts, whereby both the cathode current and the anode current can be channeled into the inner cavity or out of the inner cavity.

In an advantageous embodiment, the anode and the cathode are at least partly bordering to the inner cavity. A part of the inner cavity must always be formed either by the carrier plate or a flat protective element. In this way, the non-metalized surface on the flat protective element or the carrier plate is to be kept sufficiently large, so that the distance between anode and cathode with specified operational voltage will not lead to unintended electric flash-over.

In an advantageous embodiment, the detector elements are connected with analysis circuits, whereby the analysis circuits are arranged in the beam path relevant for the measurement and are shielded by means of shielding metalizations. The arrangement in the beam path means the ionizing radiation would impinge on the analysis circuits due to the position of the same if no shielding were present. This usually leads to a very compact detector plate, whereby, however, the risk of failure of an analysis circuit is taken into account, if this were damaged by an ionizing radiation dose. In this way, it is possible to protect the analysis circuits from the ionizing radiation with shielding metalizations on the carrier plate, or, for example, other conductor plates. Here, copper especially is suitable as a metalization material, because this can be applied at an acceptable thickness of up to 400 micrometers.

In an advantageous embodiment, the detector elements are electrically connected with analysis circuits, whereby the analysis circuits are arranged partly or entirely outside of the beam path relevant to the measurement. Alternatively, conductor paths can be used to channel the ionization current of the detector elements onto the carrier plate, until a region is reached that is not subject to any ionizing radiation. In this region, alternatively, the analysis circuits can be arranged. Such a region is preferably arranged in a periphery of the detector plate.

For example, this analysis circuit is formed, either partly or entirely, from an electrometer amplifier intended to measure the ionization current of one or more detector elements. It is advantageous if the analysis circuit also has an analog-digital inverter that converts the extremely minor ionization current measured by the electrometer amplifier into a digital signal. The electrometer amplifier can be designed as a display unit used for reading out the digital current data if necessary. Most of the analysis circuits have integrated circuits in the form of so-called "ICs" to implement the required functions electronically.

The inventive process to produce a detector plate consisting of one, especially injection-molded, carrier plate with a number of detector elements for detecting ionizing radiation includes the following steps:

Production of the carrier plate by means of an injection molding process, non-cutting production and/or press-molding, Addition of the electro-conductive applications used in the detector elements, such as anode and/or cathode, especially metalizations, whereby at least one of the electro-conductive applications is not localized in a single plane.

BRIEF DESCRIPTION OF THE DRAWINGS

Shown are.

DETAILED DESCRIPTION OF THE FIGURES

Figure 3A:
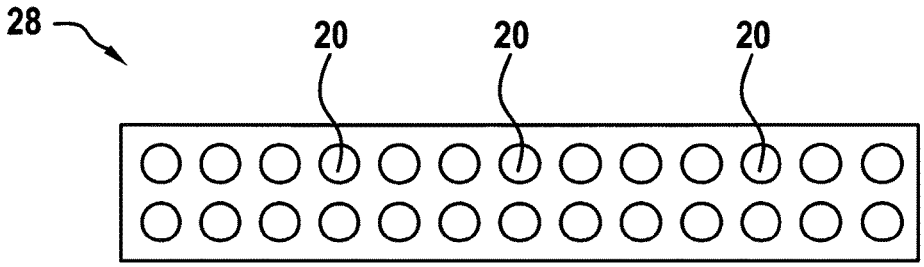
Figure 3B:
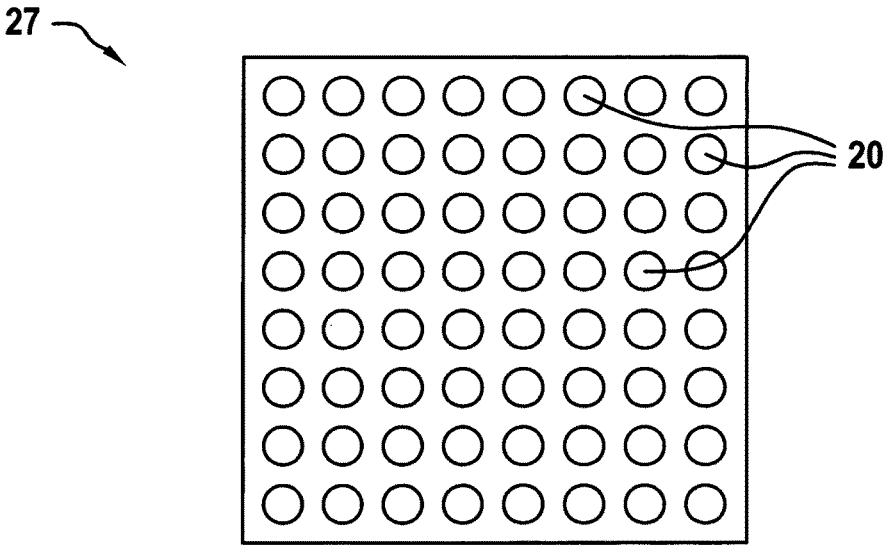
Figure 4:
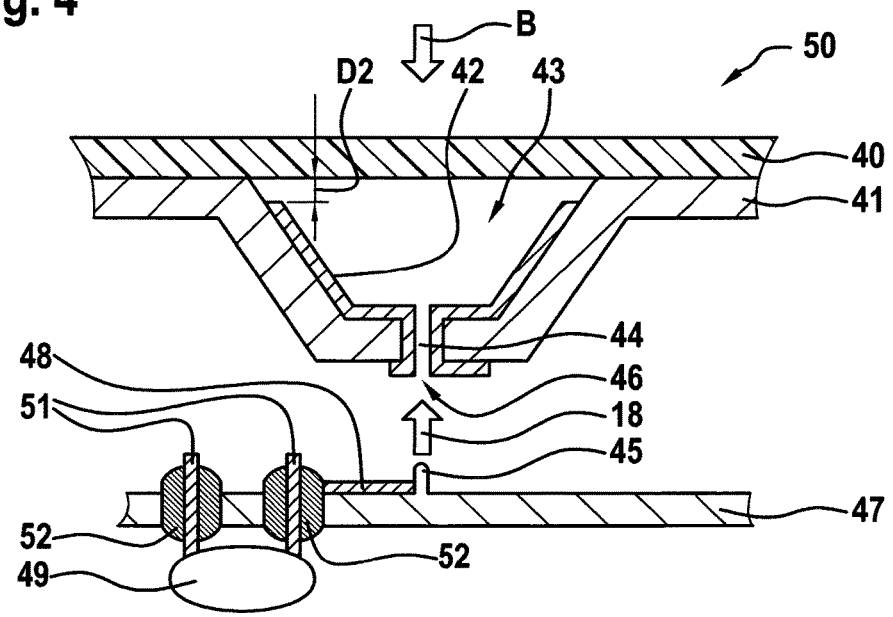
Figure 5:
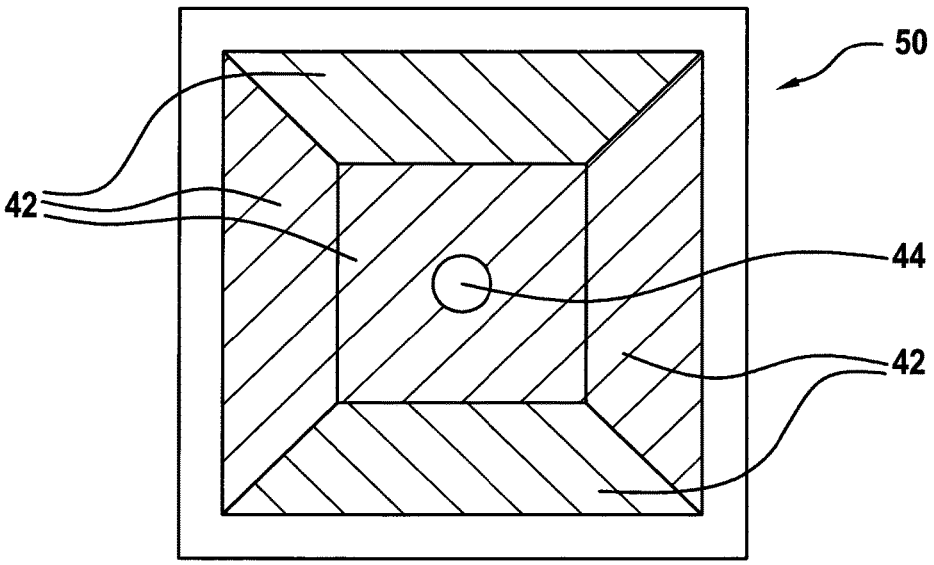

FIG. 3A and FIG. 3B present two possible detector plates 27 and 28, which can be set via corresponding arrangements of detector element 20 on the radiation profile to be measured. In this way, a number of applications can be considered through the corresponding resolution of any two-dimensional surface.

It is of advantage if common conductor plates 47 can be connected with the detector element 50 by means of the described method, whereby any switching circuits on the paths of the ball grate contact can be used with a number of detector elements 50 or different detector elements. Only through the similar arrangement of all contact areas 46 and all balls used 45, is it possible to have simultaneous multiple contacts in one work step.

The electronic component 49 should only be regarded as an example of the range of possible components, such as an electrometer amplifier, just like the type of electrical connection with the conductor plate 47 that is guaranteed here via contact legs 51 and solder points 52, and which can be replaced by other connections.

The ionizing radiation follows the radiation direction B through the metal plate 40 in the inner cavity 43, which, with corresponding thickness only marginally absorbs the ionizing radiation. Alternatively, a radiation direction B can be chosen that reaches through carrier plate 41, whereby only an absorption-resistant plastic hinders the ionizing radiation.

Figure 6:
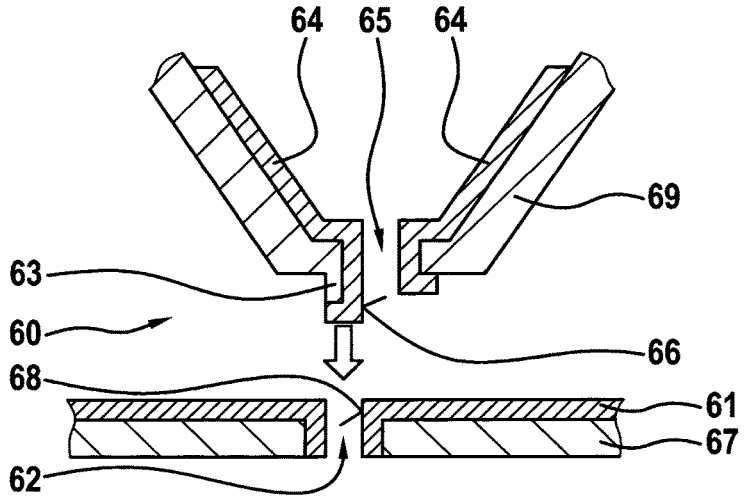
Figure 7A:
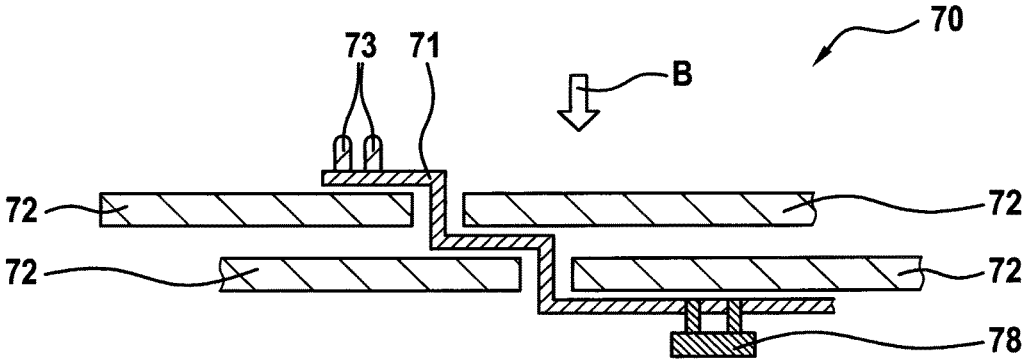
Figure 7B:
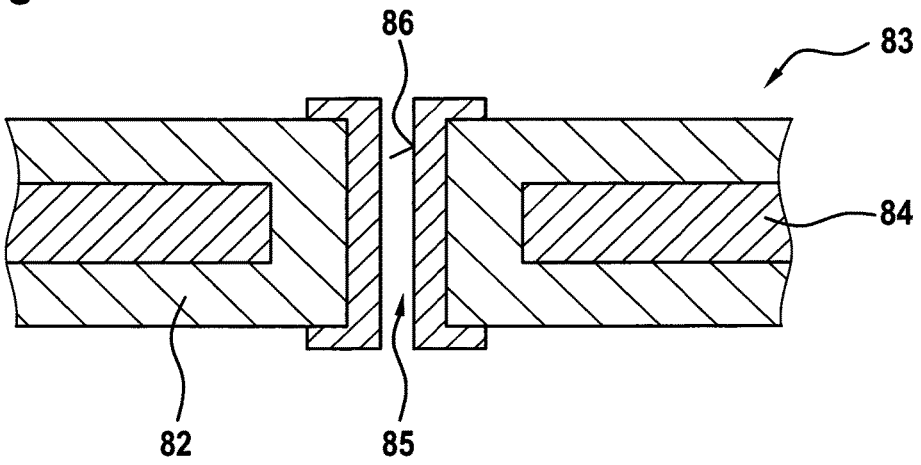
Figure 8:
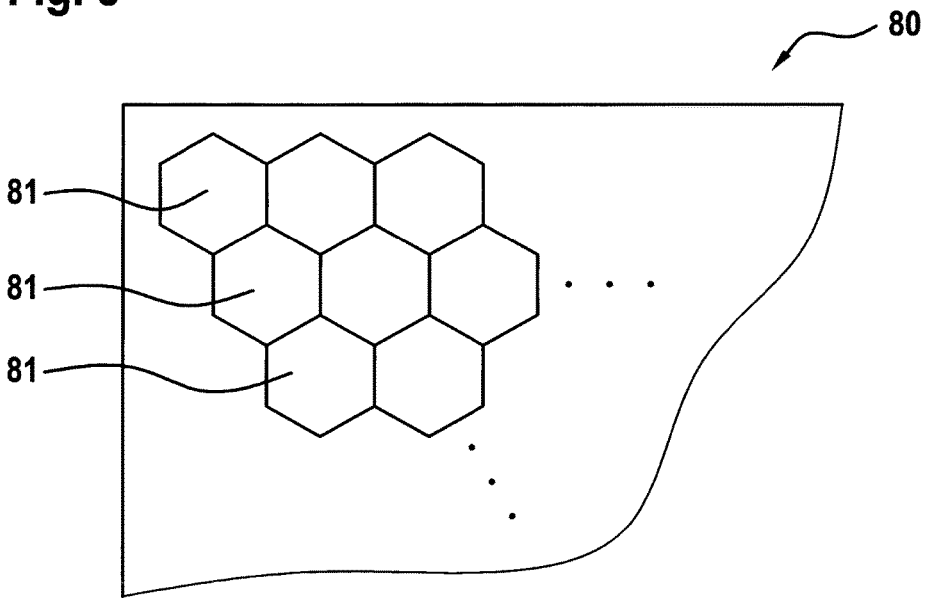
Figure 9:
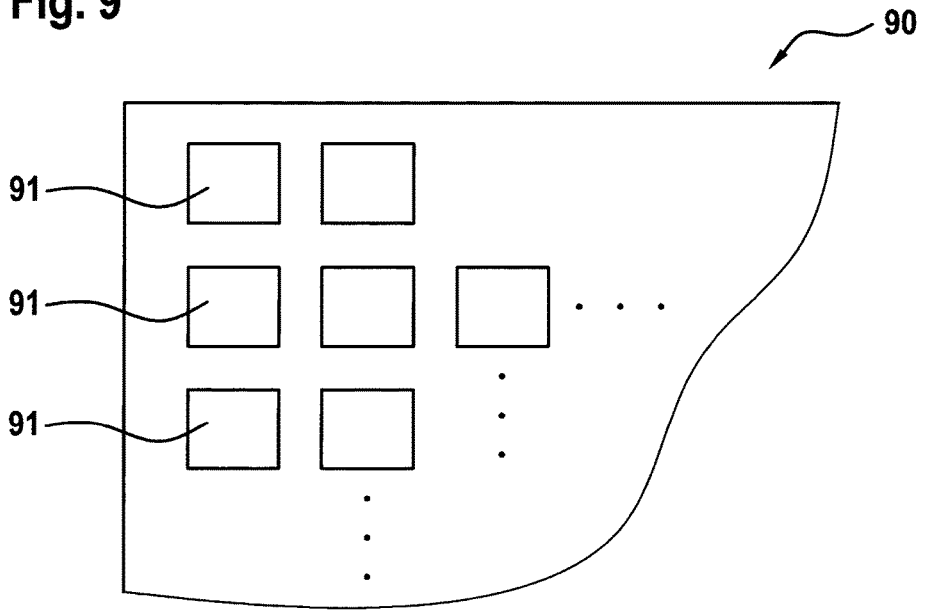
Figure 10:
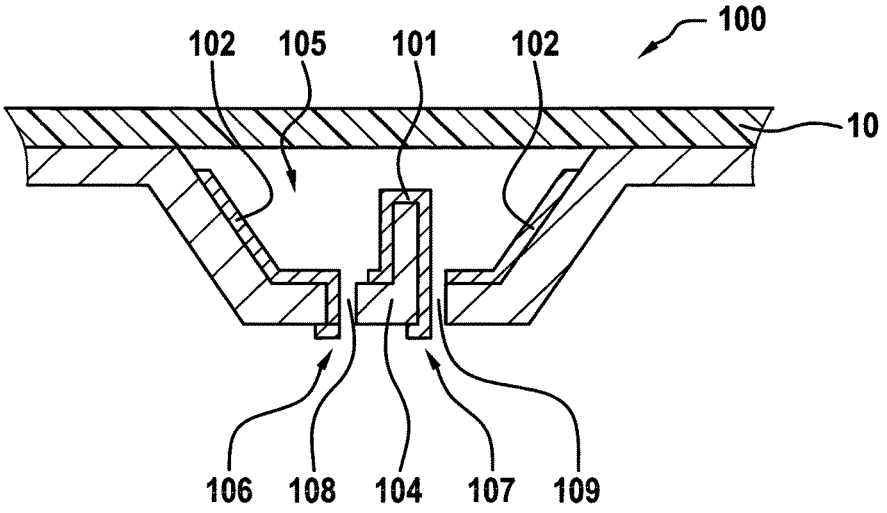

FIG. 6 shows a conducting plug connection between a cathode 64 that was metalized in a detector element. The opening 65 shows a through-contact of cathode 64, that continues on an extension 63, arranged directly next to opening 65. On the pegs 63, the metalization forms a contact surface 66 that contacts conductively a counter-contact surface 68 as soon as the pegs 63 are clamped in the opening 62 of conductor plate 67. The electrically contacting plug connection 60 can thus be brought about by simply plugging the conductor plate 67 onto the detector elements, whereby the grate arrangement, another very advantageous production benefit occurs, especially as further steps must not be undertaken for electrical contact or attachment.

The honeycomb of the detector elements 81 leads to an extremely effective arrangement, whereby almost the entire surface of the carrier plate of detector plate 80 can be used as an electron surface or a detector surface. In this way, only a very small part of the surface of the carrier part is left unused.

Figure 1:
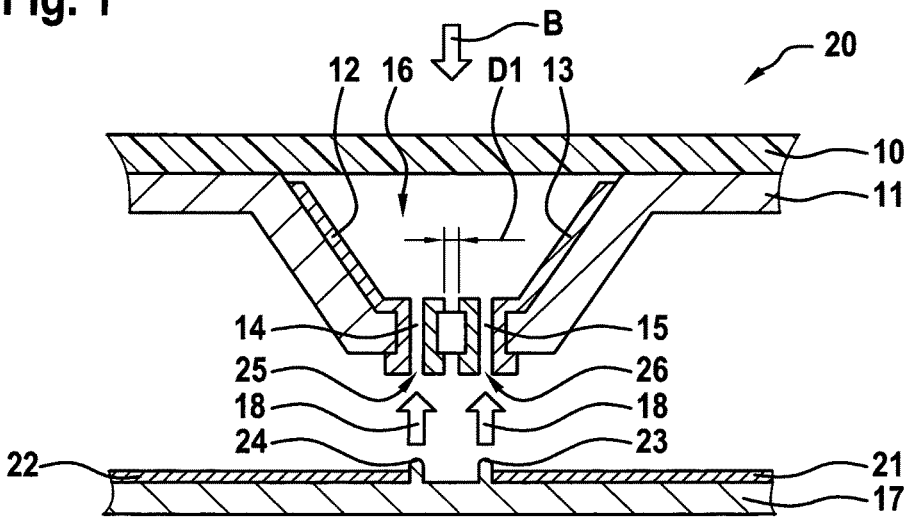
FIG. 1 a first design example of a cut detector element in a production step shortly before contacting a conductor plate, FIG. 2 the detector element from FIG. 1 from the direction of the radiation intrusion, FIG. 3A,B one design example of a detector plate respectively, FIG. 4 a second design example of a cut detector element shortly before contact with a conductor plate, FIG. 5 the detector element from FIG. 4 from the direction of the radiation intrusion, FIG. 6 a schematic presentation of a plug connection between a detector element and a conductor plate, FIG. 7A,B possible shielding arrangements for shielding electrical or electronic components, especially of analysis circuits, FIG. 8 a detector plate with honeycomb detector elements, FIG. 9 a detector plate with rectangular detector elements, and FIG. 10 sectional view of a detector element with protective foil.
Figure 2:
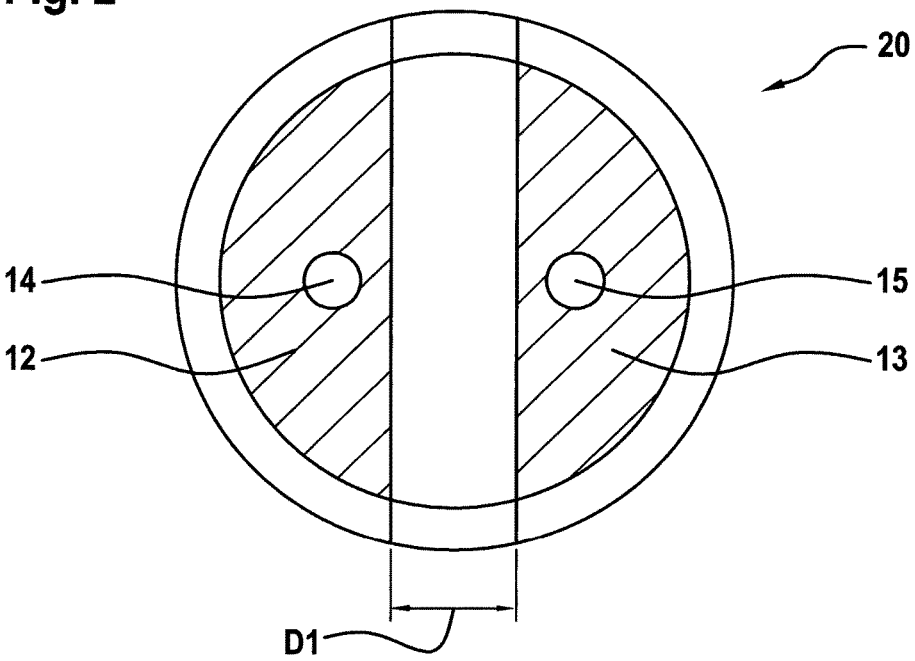

In all embodiments, carrier plate 11, 41 can be manufactured through an injection molding process, as well as through non-cutting production and/or molding. In principle, injection molding is advantageous where greater complexity is involved. However, for example, carrier plate 11 shown in FIGS. 1 and 2 are manufactured through a pressing or stamping process (molding), followed by drilling the openings 14, 15 (cutting production).

In summary, the invention concerns a detector plate consisting of a specially injection-molded carrier plate with a number of detector elements for detecting ionizing radiation. The detector elements function according to the principle of a Geiger-Müller counter, whereby the invention also suggests, in order to simplify the production process and reduce costs, that the anode and/or cathode is not formed in a metalization process lying in a single plane on the carrier plate of the detector plate. This leads to many possibilities to form the inner cavity used as ionization chamber, and to arrange the electrodes in this area. The contact possibilities with further circuit boards also prove extremely advantageous. This also has an advantageous effect on the production process and on the quality of the radiation measuring devices that use such detector plates.

DESIGNATION LIST

B Radiation direction
D1 First high-voltage distance
D2 Second high-voltage distance
10 Protection foil
11 Carrier plate
12 Anode
13 Cathode
14 First opening
15 Second opening
16 Inner cavity
17 Conductor plate
18 Contact movement direction
20 Detector element
21 Second conductor path
22 First conductor path
23 Ball
24 Ball
25 Contact area
26 Contact area
27 Detector plate
28 Detector plate
40 Cathode formed as metal plate
41 Carrier plate
42 Anode
43 Inner cavity
44 Opening
45 Ball
46 Contact area
47 Conductor plate
48 Conductor path
49 Electrical structural element
50 Detector element
51 Contact leg
52 Solder point
60 Electrically contacting plug connection
61 Conductor path
62 Plug opening
63 Peg
64 Cathode
65 Opening
66 Contact surface
67 Conductor plate
68 Counter-contact surface
69 Carrier plate
70 Shielding arrangement
71 Conductor plate
72 Copper shielding
73 Ball
78 Electronic structural element
80 Carrier plate
81 Detector element
82 Synthetic resin
83 Shielding
84 Metal insert
85 Opening
86 Metalization
90 Carrier plate
91 Detector element
100 Detector element
101 Anode
102 Cathode
104 Pin
105 Inner cavity
106 Contact area
107 Contact area
108 Opening
109 Opening

The invention claimed is:

1. A detector plate consisting of:

an injection-molded carrier plate with a plurality of detector elements for detection of ionizing radiation, the detector elements being adapted for generating an electrical ionization current between an anode and a cathode of the respective detector element with indirect or direct ionization by the ionizing radiation in an inner cavity of the respective detector element;

wherein the anode and/or the cathode is formed as an electro-conductive application not lying in a single plane on the injection-molded carrier plate;

wherein the inner cavity is formed at least partly by a depression in the carrier plate, the depression of the respective detector element having an opening or two openings; each opening having one through-contact through the carrier plate.

2. The detector plate according to claim 1, wherein the electro-conductive application is a metalization, a carbonization, or a conductive ink.

3. The detector plate according to claim 2, wherein the anode and/or the cathode comprises at least two electro-conductive applications.

4. The detector plate according to claim 3, wherein the through contact formed by the at least two electro-conductive applications conducts an anode current or a cathode current externally from the inner cavity of the detector element.

5. The detector plate according to claim 1, wherein the anode and the cathode are at least partly bordering to the inner cavity.

6. The detector according to claim 1, wherein the inner cavity is partly bordering to a flat protective element, and the flat protective element partly or completely forms the anode or the cathode.

7. The detector plate according to claim 1, wherein the anode and/or the cathode is/are arched, or at least has/have two surfaces with differently oriented surface normals.

8. The detector plate claim 1, wherein detector elements are electrically connected with analysis circuits, wherein the analysis circuits are arranged, either partially or entirely, in a beam path relevant for the measurement and are shielded by means of shielding metalizations.

9. The detector plate according to claim 8, whereby the contact area spreads over a peg, and the peg is adapted to produce a conductive plug connection.

10. The detector plate according to claim 1, wherein detector elements are electrically connected with analysis circuits, wherein the analysis circuits are arranged, either partially or entirely outside the beam path relevant for the measurement.

11. The detector plate according to claim 1, wherein the anode and/or cathode is connected conductively with a contact area or has a contact area, wherein the contact area is arranged outside of an inner area.

12. The detector plate according to claim 1, wherein the carrier plate forms a counter arrangement to a ball grate contact by the through-contacts.

13. A radiation analysis device with a detector plate according to claim 1.

14. The detector plate according to claim 1, wherein the anode and/or the cathode comprises at least two electro-conductive applications.

15. The detector plate according to claim 14, wherein the through contact formed by the at least two electro-conductive applications conducts an anode current or a cathode current externally from the inner cavity of the detector element.

16. A process geared to produce a detector plate consisting of a carrier plate with a number of detector elements for detecting ionizing radiation with the following steps:

producing the carrier plate by an injection molding process, non-cutting production and/or recasting, applying the electro-conductive applications used in the detector elements as anode and/or cathode, wherein at least one of the electro-conductive applications is not localized in a single plane;

wherein the inner cavity is formed at least partly by a depression in the carrier plate, the depression of the respective detector element having an opening or two openings; each opening having one through-contact through the carrier plate.

17. The process according to claim 16, wherein the anode and/or the cathode is formed from at least two electro-conductive applications.

18. The process according to claim 17, wherein the at least two electro-conductive applications form a through-contact on the carrier plate.

* * * * *